US006499617B1

(12) United States Patent
Niedospial, Jr. et al.

(10) Patent No.: US 6,499,617 B1
(45) Date of Patent: Dec. 31, 2002

(54) ROTARY SEAL STOPPER

(75) Inventors: John J. Niedospial, Jr., Burlington, NJ (US); Mark E. Gabbard, Delmar, DE (US); Timothy J. Gabbard, Salisbury, MD (US)

(73) Assignee: Brocco Diagnostics, Inc., Princeton, NJ (US)

( * ) Notice: Subject to any disclaimer, the term of this patent is extended or adjusted under 35 U.S.C. 154(b) by 367 days.

(21) Appl. No.: 09/617,609

(22) Filed: Jul. 17, 2000

(51) Int. Cl.[7] ..... B65D 41/16

(52) U.S. Cl. ..... 215/320; 215/50; 215/53; 215/316; 215/355; 141/301; 604/905

(58) Field of Search ..... 215/50, 53, 208, 215/211; 141/301, 310, 312; 604/905

(56) References Cited

U.S. PATENT DOCUMENTS

| | | | | |
|---|---|---|---|---|
| 2,289,677 A | | 7/1942 | Perelson | 215/47 |
| 2,326,490 A | | 8/1943 | Perelson | 215/47 |
| 2,342,215 A | | 2/1944 | Perelson | 215/38 |
| 2,667,986 A | | 2/1954 | Perelson | 215/48 |
| 3,872,992 A | | 3/1975 | Larson | 215/249 |
| 3,940,003 A | | 2/1976 | Larson | 215/247 |
| 3,977,555 A | | 8/1976 | Larson | 215/247 |
| 4,412,623 A | | 11/1983 | Schmidt | 215/11 |
| 5,232,109 A | | 8/1993 | Tirrell et al. | 215/247 |
| 5,364,386 A | | 11/1994 | Fukuoka et al. | 215/411 |
| 5,429,256 A | | 7/1995 | Kestenbaum | 215/247 |
| 5,433,330 A | | 7/1995 | Yatsko et al. | 215/247 |
| 5,451,374 A | * | 9/1995 | Molina | 422/99 |
| 5,702,019 A | * | 12/1997 | Grimard | 215/301 |
| 5,921,419 A | | 7/1999 | Niedospial et al. | 215/247 |
| 5,971,181 A | | 10/1999 | Niedospial et al. | 215/247 |
| 6,383,168 B1 | * | 5/2002 | Landau et al. | 604/236 |

* cited by examiner

*Primary Examiner*—Thomas Denion
*Assistant Examiner*—Ching Chang
(74) *Attorney, Agent, or Firm*—Imre Balogh

(57) ABSTRACT

Rotary seal valve/container assembly allowing withdrawal of a medical fluid contained in the container by the use of a device such as a syringe or IV set having a luer connector. The rotary seal valve includes: an elastomeric stopper having a cavity; a rotary seal bottom insert positioned in the bottom portion of the cavity; a rotary seal top insert, equipped with threads and serving as a male luer connector, rotatably engaging the bottom insert. One or more holes are provided in the bottom inset and top insert which holes are alignable with each other, by rotating the top insert, forming one or more channels through which the medical fluid is accessed. Upon rotating the top insert in opposite direction the rotary valve can be closed. A removable cap positioned over the rotary seal valve maintains the rotary seal valve in aseptic condition.

19 Claims, 8 Drawing Sheets

FIG. 3
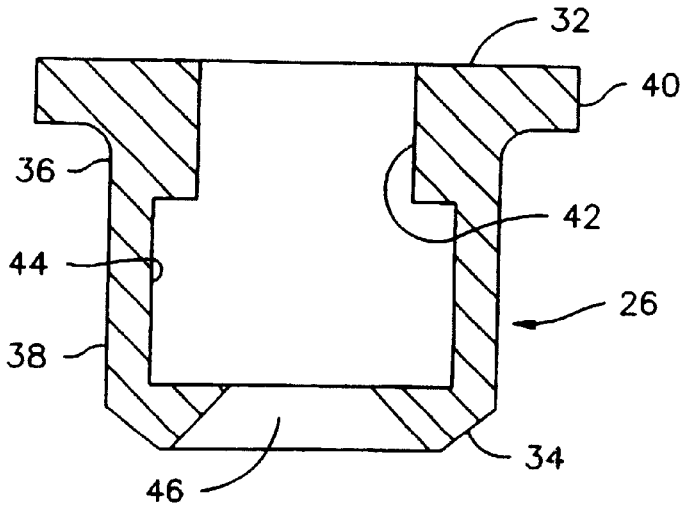
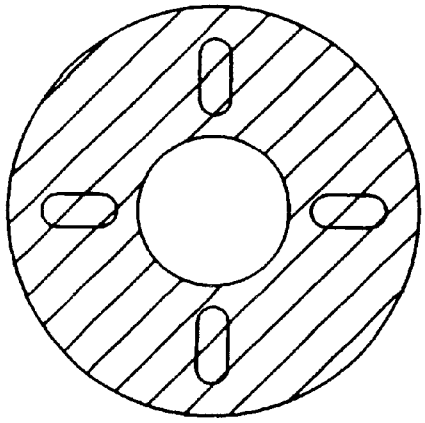
FIG. 4
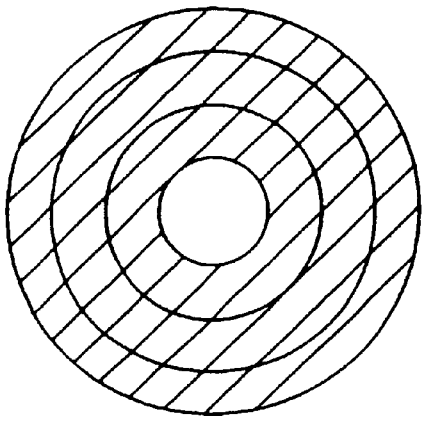
FIG. 5

FIG. 6
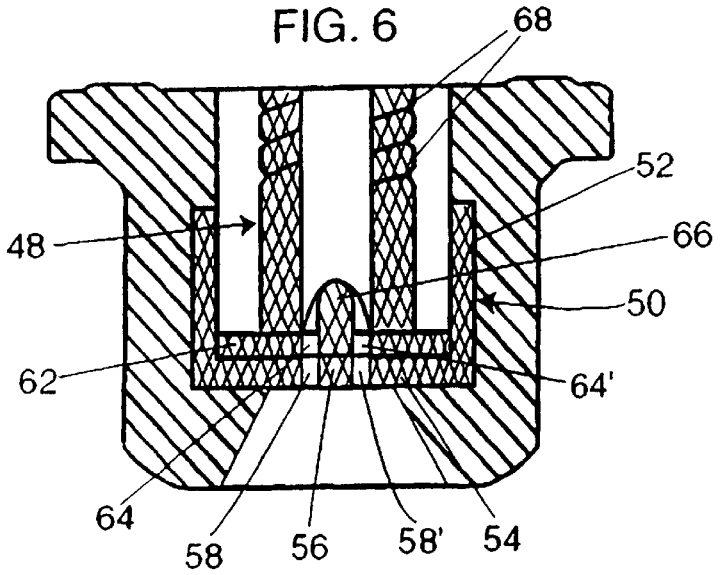
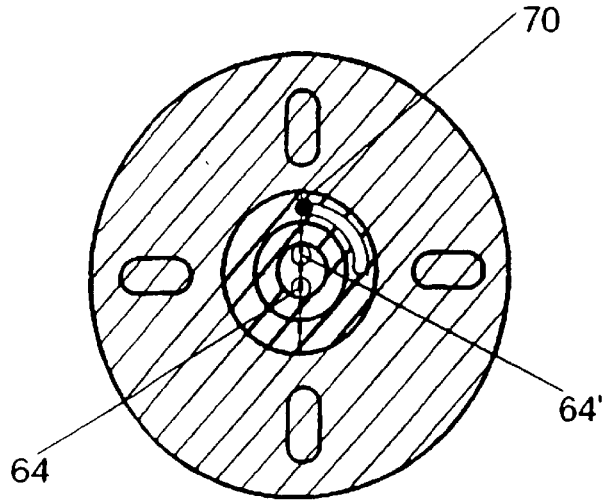
FIG. 7
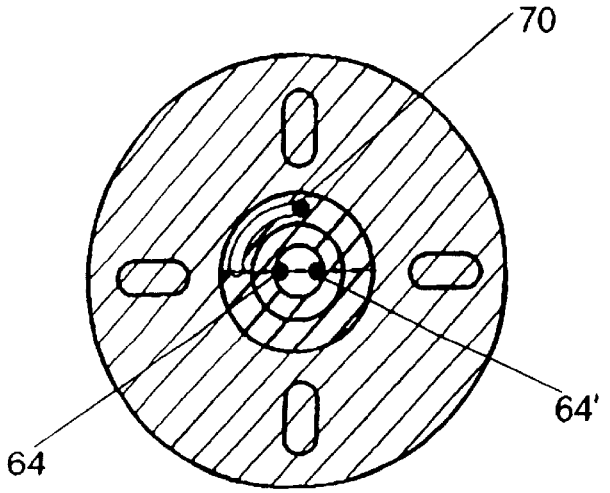
FIG. 8

FIG. 9
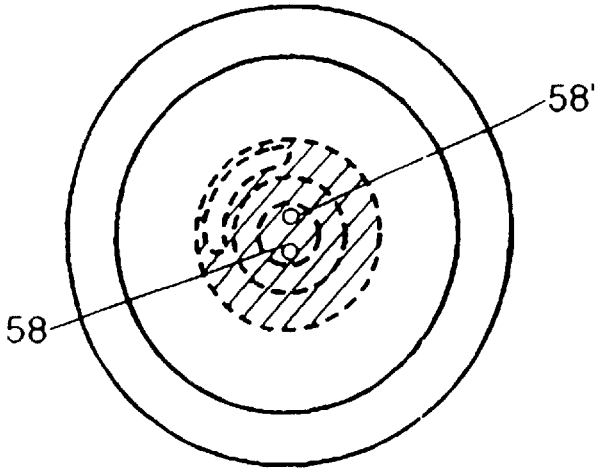
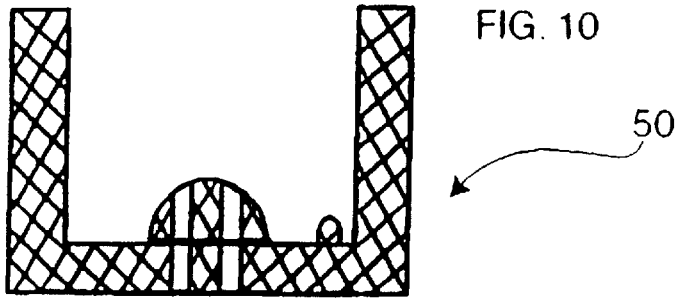
FIG. 10
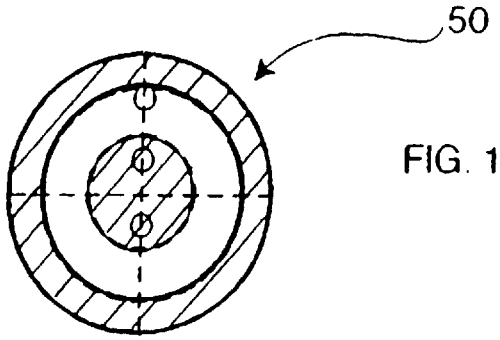
FIG. 11
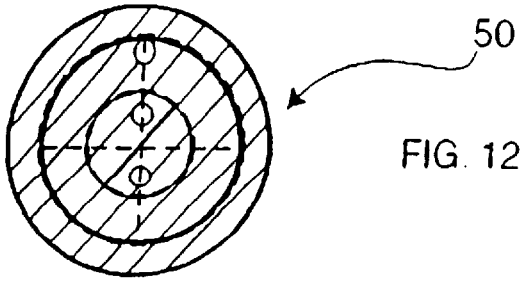
FIG. 12

FIG. 13
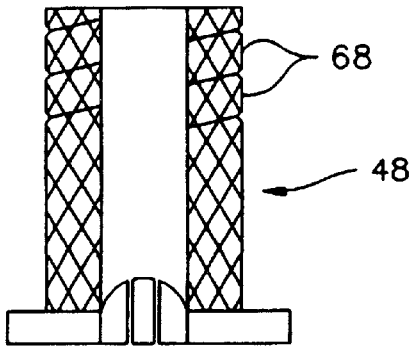
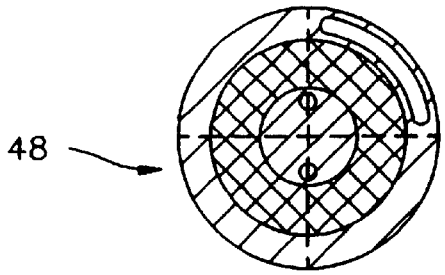
FIG. 14
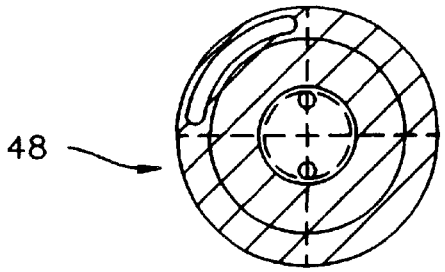
FIG. 15
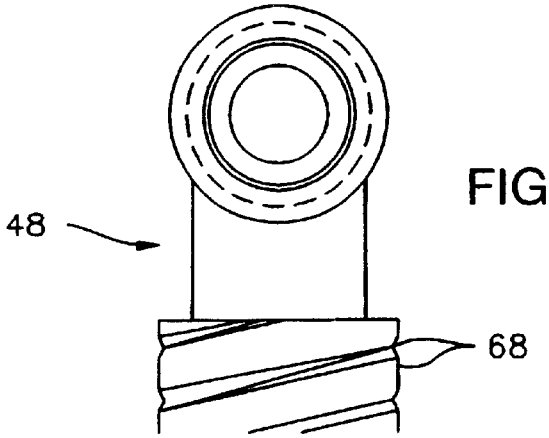
FIG. 16

FIG. 17
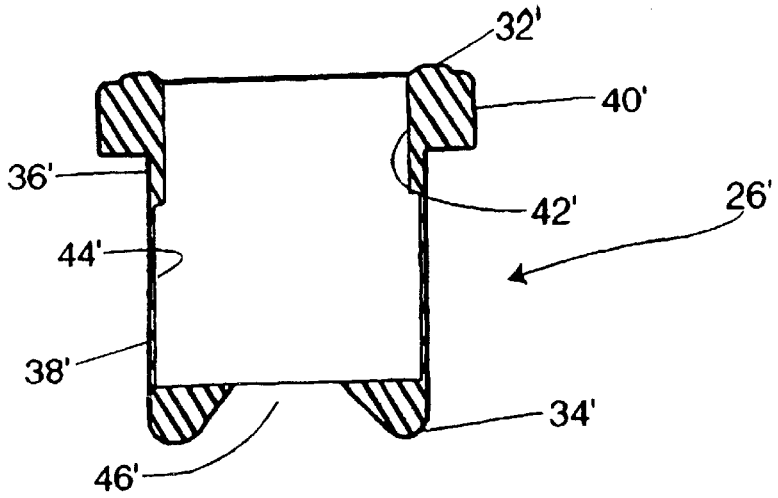
FIG. 18
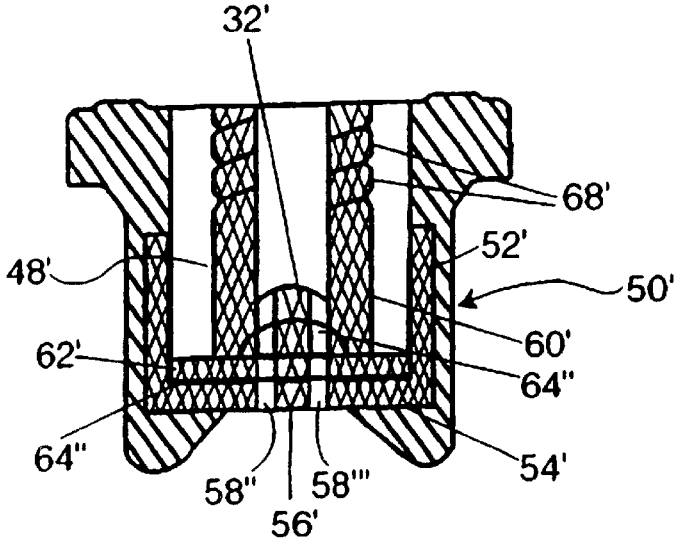
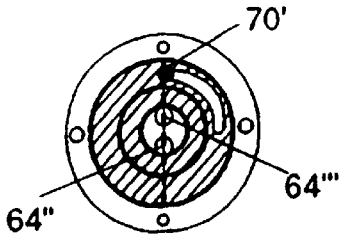
FIG. 19
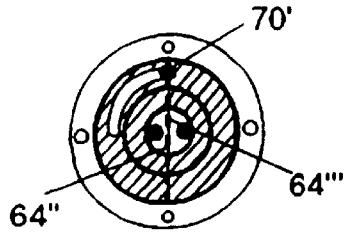
FIG. 20

ROTARY SEAL STOPPER

BACKGROUND OF THE INVENTION

1. Field of the Invention

The present invention is directed to a rotary seal stopper used in association with a container, such as a bottle or vial, for the containment and delivery of parenteral solutions, such as diagnostic contrast media and drug formulations. More particularly, the invention relates to a needleless access means having a rotatable seal therein for opening and closing the container for delivery of the parenteral solution to a site through luer connections.

2. Report Developments

There is an increasing worldwide demand for medical safety devices including safety syringes and other transfer devices. Needle stick injuries number about one million per year in the U.S. alone, resulting in thousands of hepatitis C infections.

The prior art has developed numerous devices to prevent accidental needle strike injuries to practitioners and patients. Such injuries are known to spread infectious diseases including hepatitis and AIDS. One of the main features of these devices is the lack of exposed sharp needles. The closures or stoppers have built-in access means to the content of the containers, such as vials, cartridges and bottles. The closures or stoppers in these devices serve the dual function of hermetically sealing the container while allowing safe access to the content therethrough.

Stopper systems for containers such as vials and bottles are made of materials that are resistant to chemicals and pharmaceuticals such as corrosive materials, reagents, parenteral solutions and solid formulations reconstitutable with a solvent prior to use. The most commonly used stopper/container system for such products has been glass or plastic bottles and vials equipped with stoppers made of elastomeric materials. The system provides for good hermetical seal, safe storage and easy access to the content through the elastomeric stopper via the use of an infusion spike or a syringe when withdrawal of the content is desired. The elastomeric stopper used generally comprises an elastomeric base, such as natural or synthetic rubber and an inert coating covering at least some portions of the stopper. The coating used includes chlorobutyl rubber, polymeric fluorocarbon resins such as polytetrafluoroethylene and various thermoplastic films. The coating is intended to insulate the elastomeric stopper base from the contents of the container in order to prevent contact and possible chemical reactions therebetween.

Generally, the elastomeric stopper is of cylindrical shape and has a flange head portion overlying the open top end of the container. Integral with the head portion is a body portion which extends into the open end and seated in the neck portion of the container, the diameter of the body portion being somewhat larger than the inside diameter of the container so that a tight seal is created between the body portion and the wall of the container. The lower end of the body portion is beveled towards the central, longitudinal axis of the body portion to facilitate the insertion of the body portion into the container. The circular bottom surface that faces the contents of the container is substantially planar and is imperforate, having no recess therein. The head portion of the stopper is provided with a central recess extending downwardly from the top thereof a substantial distance into the body portion so that the central recess and the circular bottom surface define a diaphragm. The walls forming the recess are generally cylindrical but may be provided with one or more circular protuberances extending inwardly to terminate just short of the center line of the stopper. The circular protuberances serve to press against and hold the needle of a syringe when the needle is inserted through the recess to penetrate the diaphragm for removal of the contents of the container. The elastomeric stopper is held in position by a metal ring or cap usually constructed of aluminum. The metal ring or cap has a removable center opening for allowing insertion of the syringe needle into the container.

Various stopper and access systems exist in the prior art to hold and remove the contents of containers which are illustrated hereunder.

U.S. Pat. Nos. 2,289,677 and 2,326,490 disclose a rubber stopper for use in vials comprising: an outer wall which serves as a seal between the vial and the stopper; and an inner wall forming a chamber in the center of the stopper, the bottom portion of the inner wall serving as a diaphragm. A hollow needle, having a sharp end for piercing the diaphragm, and an outer end exposed for connection with a syringe, is carried by the outer wall. A syringe connected to the outer end of the needle and pushed inwardly effects piercing of the diaphragm thereby permitting aspiration of the contents of the vial.

U.S. Pat. No. 2,342,215 discloses a dispensing and sealing stopper for a vial comprising: a stopper body having a hollow needle therein, one end of said hollow needle is in constant communication with the contents of the vial, and the other end is sealed by a penetrable, thin membrane. When withdrawal of the contents of the vial is desired, a syringe is inserted into the stopper to penetrate the thin membrane and to engage the other end of the hollow needle. When the syringe is removed, the thin membrane self-closes to maintain the hollow needle and the contents of the vial sterile.

U.S. Pat. No. 5,232,109 discloses an elastomeric stopper for a bottle, said stopper includes an annular protuberance which forms a second seal with the shaft of a spike inserted in the stopper to prevent leakage, blow-out and introduction of particulate matter into the fluid-containing bottle.

U.S. Pat. No. 5,364,386 relates to an infusion unit which comprises: a flexible, large container, a small medicine vial and a pipe which serves to communicate between the large, flexible container and the small medicine vial.

The large container is adapted to hold a solvent or diluent, while the medicine vial contains a powdery medicine which is to be mixed and dissolved in the solvent or diluent contained in the large, flexible container. Upon dissolution, the mixed medicine is discharged through an outlet at the lower end of the large container for infusion into a patient.

U.S. Pat. No. 5,429,256 pertains to a drug withdrawal system for a vial. The withdrawal system comprises: a vial containing a medicament therein and closed with a rubber gasket; and an apparatus which snap fits on top of the vial. The apparatus comprises: a chassis and a cap which is attached to the cap by a living hinge.

The chassis is cylindrical and has vertical grooves on the external sides to facilitate handling. The top of the chassis has a central opening. The chassis includes a male luer lock adapter having external threads thereon, and a ferrule structure the lower end of which has a hollow sharpened lance. The apparatus is used with a syringe having a female luer lock connector which snap fits with the male luer lock adapter.

In use, the cap cover is opened, and a syringe is screwed onto the outer end of the adapter. The syringe is then tightened on the adapter which moves the lance downward and the lance penetrates the gasket on the vial thereby establishing flow communication with the content of the vial. The content of the vial is withdrawn by pulling back on the plunger of the syringe. The syringe is then removed with the content therein ready to receive a needle assembly for injecting the content into a patient.

U.S. Pat. No. 5,433,330 relates to a needleless access stopper used on containers with a cannula having a blunt, stopper penetrating tip.

U.S. Pat. No. 5,921,419 discloses a closure assembly having an elastomeric membrane capable of being ruptured by a luer connector.

U.S. Pat. No. 5,971,181 discloses a multiple use universal stopper having an M-shaped clastomeric membrane capable of being ruptured by a luer connector, wherein the M-shaped elastomeric membrane reseals itself after being punctured by the luer connector.

The present invention provides sealing and access means for containers, such as bottles or vials made of glass or plastic containing medical fluids, such as x-ray contrast media and parenteral liquids. The access means provides for hermatic sealing, safe handling, sterilization and storing. The sealing means are designed for multiple use so that the medical fluid can be accessed repeatedly. After each withdrawal of the desired amount of the medical fluid, the access means is closed thereby preventing contamination of the medical fluid by air-born particles, such as dust and bacteria.

SUMMARY OF THE INVENTION

In accordance with one aspect of the present invention, a rotary seal stopper/container assembly is provided to allow access to a medical fluid contained in the container by the use of any external device that is equipped with a luer connector, such as syringe or cartridge barrels and IV sets.

In another aspect, the present invention provides a method for repeatedly accessing a medical fluid contained in a container equipped with the rotary seal stopper and closing the container after each use by rotating the rotary seal in order to prevent contamination of the medical fluid by air-born particles in the environment, such as dust and bacteria. The rotary seal stopper contains no "sharps", such as sharp or blunt needle cannulas or spikes and, therefore, the use thereof does not have the risk of accidental injuries and transmittance of contagious diseases.

The rotary seal stopper/container assembly comprises:

a) a container, such as a vial, bottle, or a bag equipped with a rigid or semi-rigid exit port having an appropriate size sufficiently large to connectably receive the rotary seal stopper;

b) a rotary seal stopper assembled to the container; and c) a removable cap covering the rotary seal stopper and the neck portion of the container or the neck portion of the rigid or semi-rigid exit port of a bag to maintain the rotary seal stopper in an aseptic condition prior to use.

The container used in conjunction with the present invention is made of glass or a polymeric material known in the art. When the container is made of glass it is in the shape of a vial or bottle. Plastic containers may be in the shape of a vial, bottle or bag. The vial or bottle is of rigid or semi-flexible polymeric material, while the bag is of a pliable polymeric material. In all the configurations the container is provided with a neck portion which is sufficiently rigid and is capable of retaining its dimensions when the rotary seal stopper is inserted thereinto. The container has a neck portion terminating in an open end to receive the rotary seal stopper which is inserted in the open end to seal the content therein and to maintain it in sterile condition.

The rotary seal stopper comprises:

an elastomeric stopper;

a thermoplastic rotary valve top insert; and a thermoplastic rotary valve bottom insert, the rotary valve top and bottom inserts constituting the rotary valve. The rotary valve top insert is equipped with threads and thereby also serves as a male luer connector. The rotary valve is positioned into the elastomeric stopper such as by snapping the rotary valve into the elastomeric stopper. Alternatively, the rotary valve bottom insert may be shot molded into the elastomeric stopper followed by snapping the rotary valve top insert into the rotary valve bottom insert.

The elastomeric stopper having a head portion and a skirt portion is made of an elastomeric base, such as a natural or synthetic rubber preferably having an inert, polymeric coating thereon covering at least the medical fluid contacting portions of the stopper. Examples of elastomeric materials from which the stopper can be made include butyl rubber, isoprene rubber, silicone rubber, halogenated rubber and ethylene propylene therpolymer. Specific examples of a synthetic elastomeric rubber include: the $CH_2CF_2$—$C_3F_6$ ($C_3F_5H$) and the $C_2F_4$—$C_2F_3OCF_3$ series of elastomers made by DuPont under the tradenames of VITON® and CARLEZ®; the fluoro-silicon rubbers, such as made by Dow Corning under the tradename of SILASTIC®; and polyisobutylenes, such as VISTANEX MML-100 and MML-140; and halogenated butyl rubber, such as CHLOROBUTYL 1066 made by Exxon Chemical Company. These and other suitable elastomers may be made into the desired stopper configuration by known methods. Such methods typically include the use of a curing agent, a stabilizer and a filler and comprise a primary and a secondary curing step at elevated temperatures. The coating covering the elastomeric stopper may be of chlorobutyl rubber, polymeric fluorocarbon resins and thermoplastic films. The stopper is of cylindrical shape and has a flange head portion overlying the open top end of the container. Integral with the flange head portion is a skirt portion which extends into the open end and seated in the neck portion of the container. The inside diameter of the neck portion of the container is somewhat smaller than the outside diameter of the skirt portion so that a tight seal is created between the skirt portion and inside wall of the neck portion of the container. In the center portion of the stopper there is a cylindrical opening extending through the head and skirt portions of the stopper. The cylindrical opening is adapted to receive the rotary valve.

The rotary valve is made of thermoplastic materials such as polyethylene, polypropylene, polystyrene, polycarbonate, polymethylpentene, cyclic olefin polymers, acrylic polymers and methacrylic polymers.

A removable cap encloses the rotary seal stopper and the neck portion of the container. The cap is made of plastic, or a metal such as aluminum. The cap at its bottom portion is sealed to the neck of the container by a tear strip. At the point of use the tear strip is removed followed by removal of the cap revealing the male luer connector with locking threads thereon. A female luer connector is then attached and the contents of the container is delivered to the patient via a tubing and catheter.

The method of accessing a medical fluid contained in a container equipped with the rotary seal stopper of the present invention comprises the steps of:

a) providing the rotary seal stopper/container assembly as described herein;

b) removing the tear strip and the removable cap thereby exposing the male luer connector in the rotary seal stopper;

c) attaching an external access means having a female luer connector to the male luer connector of the rotary seal stopper;

d) turning the rotary seal top insert in the rotary seal stopper to the open position; and e) delivering the medical fluid contained in the container to a patient.

BRIEF DESCRIPTION OF THE DRAWINGS

With reference to the annexed drawings illustrating the invention:

FIG. 3 is a cross-sectional view of the elastomeric stopper;

FIG. 4 is a top plan view of the elastomeric stopper;

FIG. 5 is a bottom plan view of the elastomeric stopper;

FIG. 6 is a cross-sectional of the elastomeric stopper/rotary seal assembly showing the top insert and bottom insert of the rotary seal;

FIG. 7 is a top plan view of the elastomeric stopper/rotary seal assembly showing the rotary seal in the open position;

FIG. 8 is a top plan view of the elastomeric stopper/rotary seal assembly showing the rotary seal in the closed position;

FIG. 9 is a bottom plan view of the elastomeric stopper/rotary seal assembly showing the rotary seal in the closed position;

FIG. 10 is a cross-sectional view of the bottom insert of the rotary seal;

FIG. 11 is a top plan view of the bottom insert of the rotary seal;

FIG. 12 is a bottom plan view of the bottom insert of the rotary seal;

FIG. 13 is a cross-sectional view of the rotary seal top insert;

FIG. 14 is a top plan view of the rotary seal top insert in the open position;

FIG. 15 is a top plan view of the rotary seal top insert in the closed position;

FIG. 16 is a top plan view and a partial side elevational view of the threads on the rotary seal top insert adapted to receive an external female luer connector;

FIG. 17 is a cross-sectional view of an elastomeric stopper constituting another embodiment of the present invention;

FIG. 18 is a cross-sectional view of the elastomeric stopper/rotary seal assembly showing the top insert and bottom insert of the rotary seal positioned in the elastomeric stopper of FIG. 17;

FIG. 19 is a top plan view of the elastomeric stopper/rotary seal assembly shown in FIG. 18, showing the rotary seal in the open position;

FIG. 20 is a top plan view of the elastomeric stopper/rotary seal assembly shown in FIG. 18, showing the rotary seal in the closed position;

DETAILED DESCRIPTION OF THE INVENTION

Reference is now made to the drawings of FIGS. 1–22 illustrating the present invention.

Figure 1:
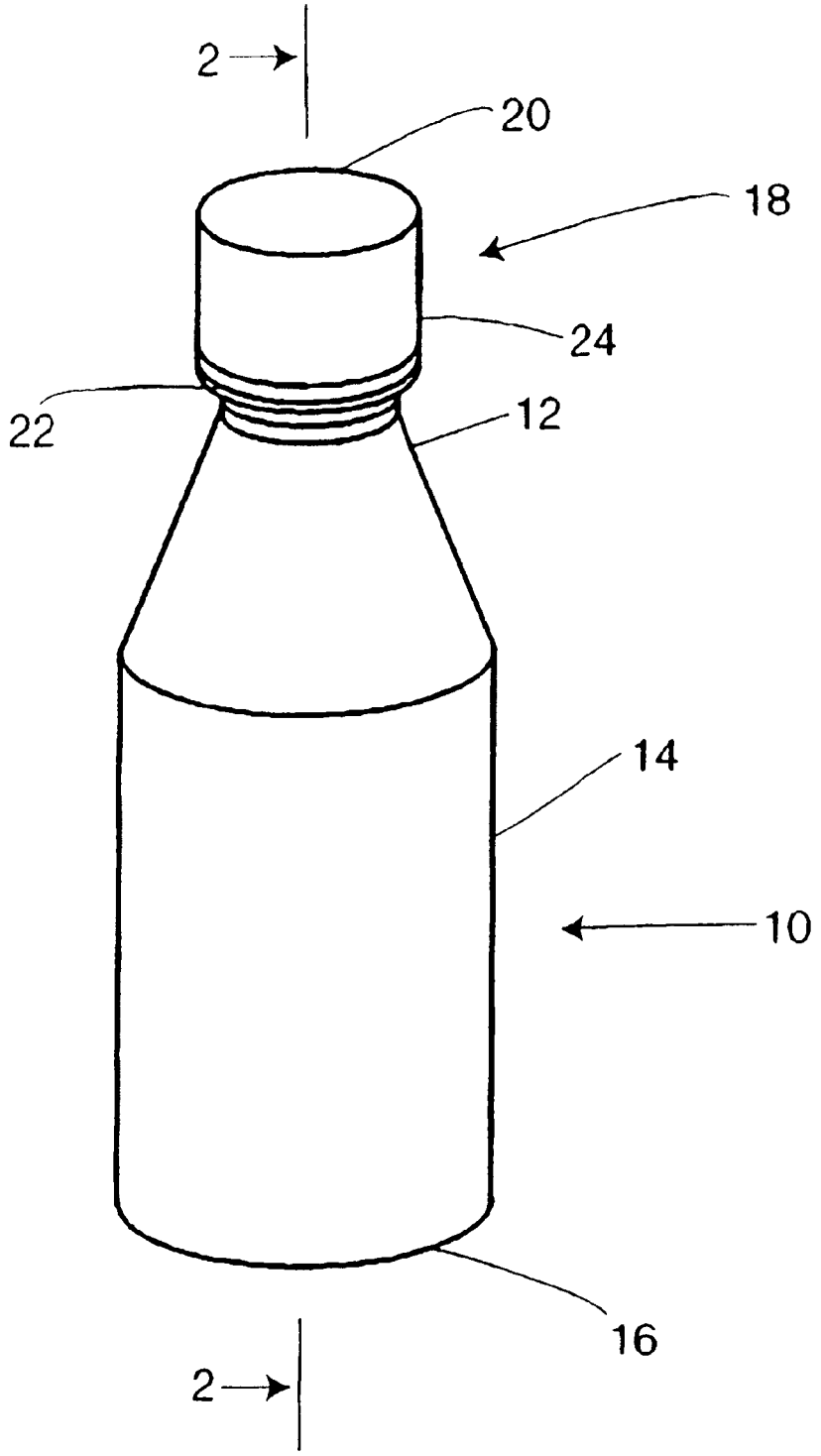
FIG. 1 is a perspective view of a container, a rotary seal stopper, and a cap.

FIG. 1 is a perspective view of a typical cylindrical container generally designated by the numeral 10 and a removable cap generally designated at 18 covering the open end of the container. The container comprises: a neck portion 12, a side portion 14, and a bottom portion 16. Removable cap 18 comprises: a flat top surface 20 and a side portion 24 which terminates in bottom rim portion 22.

Figure 2:
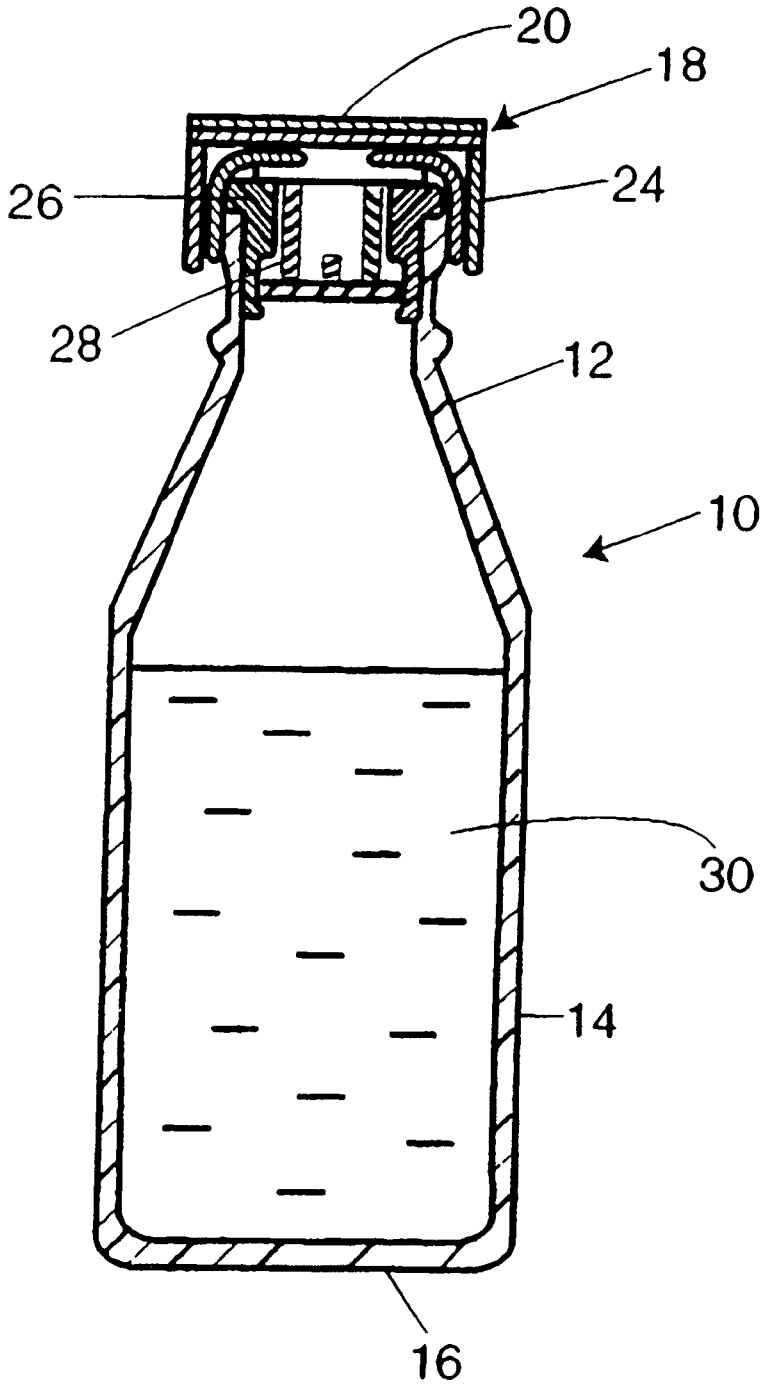
FIG. 2 is a cross-sectional view of the container, the rotary seal stopper, and the cap taken along the line 2—2 of FIG. 1.
Figure 21:
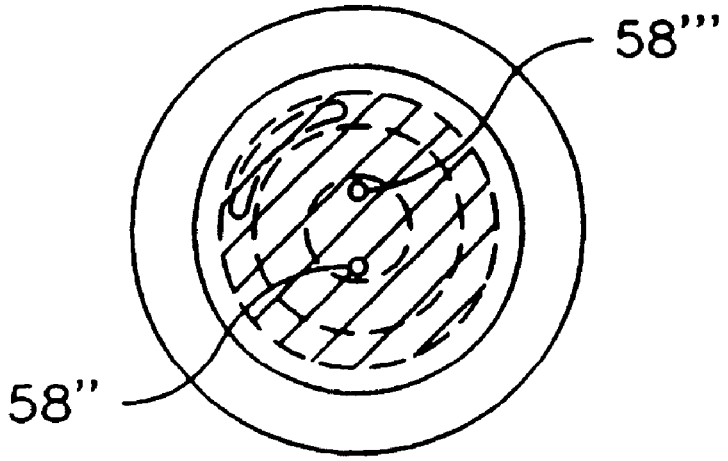
FIG. 21 is a bottom plan view of the elastomeric stopper/rotary seal assembly shown in FIG. 18, showing the rotary seal in the closed position.

FIG. 2 is a sectional view of the container 10, the removable cap 18, the elastomeric stopper generally designated at 26, and the rotary seal generally designated at 28 which is positioned in the elastomeric stopper. The container has medical liquids 30 therein, such as diagnostic media or drug formulations.

FIG. 3 is a cross-sectional view of the elastomeric stopper 26 having a top surface 32 and a bottom surface 34 and comprises: a head portion 36 and a skirt portion 38. The head portion comprises a flange 40 extending laterally outwardly from skirt portion 38 and is designed to cover the transverse end surface of the container. A cylindrical inside wall 42 defines a cylindrical opening in the head portion 36 while a cylindrical inside wall 44 defines a cylindrical opening in the skirt portion of the elastomeric stopper. Cylindrical inside wall 44 in the skirt portion is recessed providing space for a rotary seal bottom insert 48 described later in connection with FIGS. 6–12. The bottom surface 34 of the elastomeric stopper contains a funnel-shaped opening 46 therein to facilitate insertion of the elastomeric stopper in a container by compressing the bottom surface toward the opening.

FIGS. 4 and 5 are respectively top and bottom plan views of the elastomeric stopper.

FIG. 6 is a cross-sectional view of the elastomeric stopper 26/rotary seal 28 assembly showing the top insert 48 and the bottom insert 50 of the rotary seal. The two inserts are separate components of the rotary seal: the bottom insert is positioned in the cylindrical opening defined by the cylindrical wall 44 in the skirt portion 38 of the elastomeric stopper. Alternatively, the bottom insert may be shot-molded into the cylindrical opening. By either method the bottom insert is securely held in place in the cylindrical opening of the elastomeric stopper.

The bottom insert having a cylindrical body is open at its distal end and closed at its proximal end comprises: side wall 52 securely positioned into the cylindrical inside wall 44 of the elastomeric stopper; and a horizontal bottom wall 54 at the proximal end of the cylindrical body, the side and bottom walls enclosing a space designed to receive the top insert 48 of the rotary seal. At the center of the bottom wall of the bottom insert a dome-shaped protuberance 56 extends toward the distal end of the bottom insert. On both sides of the protuberance the bottom wall is provided with holes 58 and 58'.

Top insert having a cylindrical body, generally designated by the numeral 48, comprises: side wall 60; and horizontal bottom wall 62 extending parallel to the horizontal bottom wall 54 of the bottom insert and has a frictional fit therewith. Horizontal bottom all 62 of top insert 48 is provided with holes 64 and 64'.

Horizontal bottom wall 62 of top insert 48 is provided with a dome-shaped indentation 66 in its center portion thereof projecting towards the distal end of the top insert. The dome-shaped indentation conforms to the dome-shaped protuberance 56 in the bottom wall of the bottom insert. The dome-shaped indentation and the dome-shaped protuberance have frictional fit between them for relative limited rotation of the top insert with respect to the stationary bottom insert.

Side wall 60 of top insert 48 is equipped with thread 68 of from about the mid point to its distal end 70. The side wall along with the thread thereon constitutes the male luer connector for engagement with an external female luer connector.

Holes 58 and 58' in the horizontal bottom wall 54 of the bottom insert 50 are aligned with holes 64 and 64' in the horizontal bottom wall 62 of top insert 48 when the rotary valve is in the open position, thereby opening a channel through which the medical fluid content of the container can be removed.

Reference is now made to FIGS. 7–9 wherein FIG. 7 shows a top plan view of the elastomeric stopper 26/rotary seal assembly 28 (sometimes referred to herein as rotary valve) showing the rotary seal in the open position. As referred to in connection with FIG. 6, holes 64 and 64' in the top insert 48 are aligned with holes 58 and 58' in the bottom insert to allow transfer of the medical liquid through two pairs of holes which match up in this position. (Holes 58 and 58' cannot be seen in FIG. 7 since they are overlapped by holes 64 and 64').

FIG. 8 is a top plan view of the elastomeric stopper 26/rotary seal assembly 28, showing the rotary seal in its closed position. Holes 64 and 64' in the top insert 48 are disaligned or mismatched with holes 58 and 58' in the bottom insert. In this closed position the rotary valve provides a sealing function to maintain product integrity.

A detent button 70 is incorporated in the top insert to give the user a positive indication that the device has reached the open or closed position. In the embodiment shown in the drawings, rotation of the device in a clockwise direction results in the open position while rotation 90° in a counter-clockwise direction results in the closed position. Obvious alternative to rotation includes reversing the orientation of the opening and closing action to counter-clockwise to open, and clockwise to close the rotary valve. In addition, a single hole can be incorporated in the rotary valve that requires a rotation of 180° from open to closed position. More than two holes may also be incorporated in the rotary valve and the degree of rotation is adjusted based on the number of holes incorporated. The size of the holes may also be varied to provide for the desired rate of flow of the liquid medicament. Preferably, the area of the hole or holes provided in the rotary valve should equal the area of the pathway in the male luer connector, which is integral with the rotary valve, to provide for a smooth even flow of the liquid medicament from the container into the male luer connector portion of the device and out into the external female luer connector.

FIG. 9 is a bottom plan view of the elastomeric stopper 26/rotary seal assembly, showing the rotary seal in the closed position.

FIGS. 10–16 show in detail the top insert 48 and bottom insert 50 of the rotary seal wherein:

FIG. 10 is a cross-sectional view of the bottom insert 50;

FIG. 11 is a top plan view of the bottom insert 50;

FIG. 12 is a bottom plan view of the bottom insert 50;

FIG. 13 is a cross-sectional view of the rotary seal top insert 48;

FIG. 14 is a top plan view of the rotary seal top insert 48 in the open position;

FIG. 15 is a top plan view of the rotary seal top insert 48 in the closed position; and FIG. 16 is a top plan view and a partial side elevational view of the threads 68 on the rotary seal to insert 48.

The above-described invention, illustrated by FIGS. 1–16, is designed for large container/rotary seal assemblies, such as the 28 mm or larger stopper designs used in bottles or vials of 100 ml or more capacities.

Another embodiment of the present invention, illustrated by FIGS. 17–21, is intended for small container/rotary seal assemblies, such as the 20 mm or smaller stopper designs used in bottles or vials having less than 100 ml capacities. The size of the component parts of the rotary seal stopper is accordingly reduced. In FIGS. 17–21 the numerals 10–56, 60–62 and 66–70 with superscript-' refer to similar elements shown in FIGS. 1–16 by the numerals 10–56, 60–62 and 66–70 without superscript. The numerals 58", 58'", 64" and 64'" in FIGS. 17–21 refer to similar elements shown in FIGS. 1–16 denoted by the numerals 58, 58', 64 and 64'. The function of the elements shown in FIGS. 17–21 is identical with the function of the elements described and shown in the drawings of FIGS. 1–16. Based on the reduction of size of the elements in the embodiment shown in FIGS. 17–21, certain differences will be pointed out hereunder.

FIG. 17 is a cross-sectional view of the elastomeric stopper 26' having a top surface 32' and a bottom surface 34' and comprises: a head portion 36' and a skirt portion 38'. The head portion comprises a flange 40' extending laterally outwardly form skirt portion 38' and is designed to cover the transverse end surface of the container. A cylindrical inside wall 42' defines a cylindrical opening in the head portion 36' while a cylindrical inside wall 44' defines a cylindrical opening in the skirt portion of the elastomeric stopper. Cylindrical inside wall 44' in the skirt potion is recessed providing space for the rotary seal bottom insert 48'. The bottom surface 34' of the elastomeric stopper contains a funnel-shaped opening 46' therein to facilitate insertion of the elastomeric stopper into a container by compressing the bottom surface toward the opening. It is to be noted that in this embodiment of the present invention, typified by a 20 mm rotary seal stopper, the various parts of the stopper are reduced in size. Most apparent of the reduction of size is the skirt portion of the elastomeric stopper where the wall thickness of the skirt portion is greatly reduced in order to accommodate the bottom insert of the rotary seal. The following dimensions illustrate the reduction in size of this embodiment of the device of the present invention to that described in the embodiment shown in FIGS. 1–16.

| Total | Previous Embodiment (28 mm stopper) FIGS. 1–16 | Present Embodiment (20 mm stopper) FIGS. 17–21 |
|---|---|---|
| Length of stopper | 0.729" | 0.658" |
| Length of head portion | 0.237" | 0.125" |
| Length of skirt portion | 0.492" | 0.406" |
| Radius of each hole | 0.0425 | 0.0213" |

Figure 22:
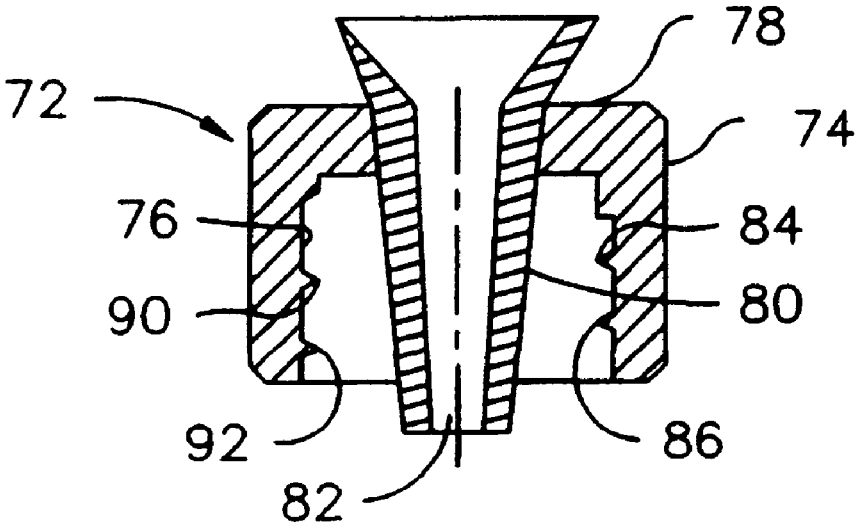
FIG. 22 shows a cross-section of a typical female luer connector with screw threads attachable to the male luer connector embodied in the present invention.

The rotary seal stopper of the present invention is used with a female luer connector when fluid communication is desired with the content of the container stoppered by the rotary seal stopper. A typical female luer connector 72 is shown in FIG. 22 and comprises: a cylindrical outside wall 76, and a cylindrical inside wall 74 having an opening in their center portion for accommodating a tubing within the inside wall. Cylindrical ring 78 located in the top center portion of cylindrical inside wall 74 tightly holds tubing 80 which has a communication channel 82. Cylindrical inside wall 74 further comprises integral screw threads 84, 86, 90 and 92 which upon connecting the female luer connector to the male luer connector, engage the male luer connector on the top insert of the rotary seal 48.

At the point of use the user connects a syringe or IV set equipped with the female luer connector with the male luer connector of the rotary seal stopper. Once connected, the user continues to rotate the female luer connector until the rotative forces are sufficient to overcome the detente of frictional relationship between the top insert 48 and the bottom insert 50. Rotation is continued clockwise for 90° from the closed position until the rotary seal stopper if fully detented and in the open position causing the pairs of holes in the top insert and the pairs of holes in the bottom insert to align. Portions or all of the liquid medication from the container is then transferred from the container to the syringe or IV set. When the desired amount of the liquid medication is transferred, the syringe or IV set equipped with the female luer connector is rotated counter-clockwise until the rotary valve is moved 90° into its closed position. The rotary seal stopper allows repeated delivery and single and multiple doses of the liquid medication contained in the container to which it is attached. It is autoclavable insuring sterility and product integrity.

PARTS LIST

| | |
|---|---|
| Container, generally designated | 10 |
| Neck portion of container | 12 |
| Side portion of container | 14 |
| Bottom portion of container | 16 |
| Removable cap, generally designated | 18 |
| Flat top surface of cap | 20 |
| Bottom rim portion of cap | 22 |
| Cylindrical side portion of cap | 24 |
| Elastomeric stopper, generally designated | 26 |
| Rotary seal in elastomeric stopper, generally designated | 28 |
| Medical liquid in the container, such as diagnostic contrast media | 30 |
| Top surface of elastomeric stopper | 32 |
| Bottom surface of elastomeric stopper | 34 |
| Head portion of elastomeric stopper | 36 |
| Skirt portion of elastomeric stopper | 38 |
| Flange of elastomeric stopper | 40 |
| Cylindrical wall defining the cylindrical opening in head portion of elastomeric stopper | 42 |
| Cylindrical wall defining the cylindrical opening in skirt portion of elastomeric stopper | 44 |
| Funnel shaped opening in skirt portion of elastomeric stopper | 46 |
| Top insert of rotary seal, generally designated | 48 |
| Bottom insert of rotary seal, generally designated | 50 |
| Cylindrical side wall of bottom insert | 52 |
| Bottom wall of bottom insert | 54 |
| Dome-shaped protuberance in bottom wall | 56 |
| Holes in the horizontal bottom wall of bottom insert | 58, 58', 58", 58'" |
| Side wall of top insert | 60 |
| Horizontal bottom wall of top insert | 62 |
| Holes in horizontal bottom wall of top insert | 64, 64', 64", 64'" |
| Dome-shaped indentation in the horizontal bottom wall of top insert | 66 |
| Threads on top insert | 68 |
| Dented button or point | 70 |

-continued

PARTS LIST

| | |
|---|---|
| Female luer connector, generally designated | 72 |
| Cylindrical inside wall of female luer connector | 74 |
| Cylindrical outside wall of female luer connector | 76 |
| Cylindrical ring in female luer connector | 78 |
| Tubing in luer connector | 80 |
| Communication channel in luer connector | 82 |
| Screw threads | 84, 86, 90 & 92 |

Having described the invention, it will be apparent to those skilled in the art that various changes and modifications may be made thereto limited only by the scope of the appended claims.

What is claimed is:

1. A rotary seal valve/container assembly for allowing access to a medical fluid contained in the container by the use of an external device equipped with a luer connector, said rotary seal valve/container assembly comprising:

(a) a container having a neck portion equipped with a rigid or semi-rigid exit port sufficiently sized to connectably receive a rotary seal valve;

(b) a rotary seal valve connected to the rigid or semi-rigid exit port of said container; and (c) a removable cap enclosing the rotary seal valve and the neck portion of the container to maintain the rotary seal valve in aseptic condition;

wherein said rotary seal valve comprises:

an elastomeric stopper having a cavity therein for receiving said rotary seal valve and being in a hermetically sealing engagement with said rigid or semi-rigid exit port of said container and said rotary seal valve;

a rotary seal top insert equipped with threads and serving as a male luer connector for attachment to a female luer connector;

a rotary valve bottom insert in frictionally rotational engagement with said rotary seal top insert;

one or more holes in each of said top and bottom inserts alignable with each other forming a channel through which a medical fluid contained in said container is accessed, and disalignable thereby closing said channel and preventing withdrawal of said medical fluid from said container; and wherein an external device equipped with a female luer connector is releasably attached to said rotary seal top insert equipped with a male luer connector for delivering said medical fluid to a patient.

2. The rotary seal valve/container assembly of claim 1 wherein said container is a vial, bottle, or a bag equipped with a rigid or semi-rigid exit port to receive said rotary seal valve.

3. The rotary seal valve/container assembly of claim 1 wherein said vial or said bottle is made of glass or a polymeric material.

4. The rotary seal valve/container assembly of claim 1 wherein said medical fluid is a diagnostic media.

5. The rotary seal valve/container assembly of claim 1 wherein said elastomeric stopper is made of natural or synthetic rubber.

6. The rotary seal valve/container assembly of claim 5 wherein said elastomeric stopper is made of butyl rubber, isoprene rubber, silicone rubber, halogenated rubber or ethylene propylene therpolymer.

7. The rotary seal valve/container assembly of claim 5 wherein said elastomeric stopper is coated with chlorobutyl rubber, polymeric fluorocarbon resins or thermoplastic films.

8. The rotary seal valve/container assembly of claim 1 wherein said rotary seal top insert and said rotary seal bottom insert are made of a thermoplastic materials.

9. The rotary seal valve/container assembly of claim 8 wherein said thermoplastic material is selected from the group consisting of polyethylene, polypropylene, polystyrene, polycarbonate, polymethylpentene, cyclic olefin polymers, acrylic polymers and methacrylic polymers.

10. A method of accessing a medical fluid contained in a container equipped with a rotary seal valve comprising the steps of:

1. providing a rotary seal valve/container assembly comprising:
   a) a container having a neck portion equipped with a rigid or semi-rigid exit port sufficiently sized to connectably receive a rotary seal valve;
   b) a rotary seal valve connected to the rigid or semi-rigid exit port of said container; and
   c) a removable cap enclosing the rotary seal valve and the neck portion of the container to maintain the rotary seal valve in aseptic condition;

wherein said rotary seal valve comprises:

an elastomeric stopper having a cavity therein for receiving said rotary seal valve and being in a hermetically sealing engagement with said rigid or semi-rigid exit port of said container and said rotary seal valve;

a rotary seal top insert equipped with threads and serving as a male luer connector for attachment to a female luer connector;

a rotary seal bottom insert in frictionally rotational engagement with said rotary seal top insert;

one or more holes in each of said top and bottom inserts alignable with each other forming a channel through which a medical fluid contained in said container is accessed, and disalignable thereby closing said channel and preventing withdrawal of said medical fluid from said container; and wherein an external device equipped with a female luer connector is releasably attached to said rotary seal top insert equipped with the male luer connector for delivering said medical fluid to a patient;

2. removing said removable cap thereby exposing the male luer connector in the rotary seal stopper;

3. attaching said external access device equipped with the female luer connector to said rotary seal top inset equipped with the male luer connector;

4. rotating said rotary seal top insert in said rotary seal stopper to the open position to align said one or more holes in the top insert with one or more holes in the bottom insert thereby opening one or more flow channels for the delivery of the medical fluids contained in the container; and 5. delivering the medical fluid or portions thereof to a patient.

11. The method of claim 10 further comprising the steps of:

rotating said external access means attached to said top insert to the closed position;

removing said external access means from said top insert; and reapplying said removable cap to the rotary seal valve to maintain the rotary seal valve and the neck portion of the container in aseptic condition.

12. The method of claim 10 wherein said container is a vial, bottle, or a bag equipped with a rigid or semi-rigid exit port to receive said rotary seal valve.

13. The method of claim 10 wherein said vial or said bottle is made of glass or a polymeric material.

14. The method of claim 10 wherein said medical fluid is a diagnostic media.

15. The method of claim 10 wherein said elastomeric stopper is made of natural or synthetic rubber.

16. The method of claim 15 wherein said elastomeric stopper is made of butyl rubber, isoprene rubber, silicone rubber, halogenated rubber or ethylene propylene therpolymer.

17. The method of claim 15 wherein said elastomeric stopper is coated with chlorobutyl rubber, polymeric fluorocarbon resins or thermoplastic films.

18. The method of claim 10 wherein said rotary seal top insert and said rotary seal bottom insert arc made of a thermoplastic materials.

19. The method of claim 18 wherein said thermoplastic material is selected from the group consisting of polyethylene, polypropylene, polystyrene, polycarbonate, polymethylpentene, cyclic olefin polymers, acrylic polymers and methacrylic polymers.

* * * * *

UNITED STATES PATENT AND TRADEMARK OFFICE

CERTIFICATE OF CORRECTION

PATENT NO. : 6,499,617 B1
DATED : February 20, 2004
INVENTOR(S) : Niedospial, Jr. et al.

It is certified that error appears in the above-identified patent and that said Letters Patent is hereby corrected as shown below:

Title page,
Item [73], the Assignee's name "Brocco Diagnostics, Inc., Princeton NJ (US)" should read -- Bracco Diagnostics, Inc., Princeton NJ (US) --

Signed and Sealed this

Thirtieth Day of March, 2004

JON W. DUDAS
*Acting Director of the United States Patent and Trademark Office*